United States Patent [19]

Könnemann

[11] 4,040,713

[45] Aug. 9, 1977

[54] DOUBLE SPRING CONTACT AND METHOD OF MAKING THE SAME

[75] Inventor: Alfred Könnemann, Wuppertal, Germany

[73] Assignee: Grote & Hartmann, Wuppertal, Germany

[21] Appl. No.: 633,989

[22] Filed: Nov. 20, 1975

[30] Foreign Application Priority Data

Nov. 21, 1974 Germany ..... 2455140
Oct. 2, 1975 Germany ..... 2544011

[51] Int. Cl.[2] ..... H01R 13/16
[52] U.S. Cl. ..... 339/259 R
[58] Field of Search ..... 339/176, 217, 258, 259

[56] References Cited

U.S. PATENT DOCUMENTS

| | | | |
|---|---|---|---|
| 3,718,895 | 2/1973 | Reynolds et al. | 339/258 R |
| 3,792,420 | 2/1974 | Konneman et al. | 339/258 R |
| 3,823,392 | 7/1974 | Pfeifer | 339/259 R |

FOREIGN PATENT DOCUMENTS

| | | | |
|---|---|---|---|
| 20,758 | 2/1961 | Germany | 339/259 F |
| 1,490,493 | 4/1969 | Germany | 339/259 F |
| 689,922 | 4/1953 | United Kingdom | 339/259 R |

*Primary Examiner*—Joseph H. McGlynn
*Attorney, Agent, or Firm*—Michael J. Striker

[57] ABSTRACT

A one-piece double spring contact has a base portion formed as a substantially tubular flattened element with a mutually parallel upper and lower wall portion and rounded sidewalls. Spring arms extend from the upper and lower walls and a claw portion extends from the lower wall at the end opposite the spring arms. The spring arms and the claw portion are offset in outward direction and a retaining spring arm is formed out of the material of the lower wall portion.

8 Claims, 4 Drawing Figures

DOUBLE SPRING CONTACT AND METHOD OF MAKING THE SAME

The invention relates to a double-flat-spring contact, which is made of one piece from a stamped sheet-metal part and has a center base portion provided with at least one retaining spring arm and a longitudinally adjacent pair of double spring arms at one end, and at the other end with a longitudinally adjacent claw part for connection of an electrical conductor.

Double spring contacts for electrical applications are already known in the art. However, they are not capable of optimally meeting the technical requirements made of them. For example, the known double spring contacts are of such construction that they require an economically not-feasible amount of material for their manufacture, and the spring characteristic is too hard for the spring arms because their spring movement path is too short. It is also disadvantageous that the retaining spring arms of these spring contacts are of such construction that in actual use they may often be bent beyond their elastic limit and thus be put out of operation.

In a known double flat-spring contact (DT-GM No. 7,147,278) the mentioned disadvantages exist cumulatively. The material section required for the manufacture of the double-spring contact is relatively large, because especially between the cut-out retaining- spring arm and the contact spring arms a connecting web must remain. The spring path of the contact spring arms is relatively short and the spriing line correspondingly hard. The retaining spring arm is not protected against overbending and can practically be bent back into the housing plane.

The problem to be solved by the invention resides in improving a double flat-spring contact having the same total length as conventional double flat-spring contacts, with reference to a more advantageous spring effect of the contact spring arms, to provide a well- functioning construction respectively arrangement of the retaining spring arm, and to manage this with a lesser total quantity of material.

It is a further purpose of the invention to so construct the finding (sic) region of the inventive double flat-spring contact that the contact blade can be reliably moved between the spring arms in all cases, when the double flat-spring contact is installed in a housing.

This problem is inventively solved in that the base portion is of a flat-tube like housing with parallel upper and lower walls and rounded sidewalls, that the spring arms adjacent the lower and upper walls and the claw part adjacent the lower wall at the other end are each stepwise bent in outward direction, and that a retaining spring arm is cut out from the lower wall.

The double spring contact according to the present invention provides for an optimum reliability and meets all the requirements made of it in technical respects. The lengths of the base portion can be relatively short because the retaining spring arm is only stamped from but not out of the base portion, and the contact spring arms therefore can be made correspondingly lower and have a relatively soft characteristic spring line. The blank of which the contact is made can be substantially narrower than before, which offers substantial advantages relative to manufacturing speed during shaping of the blank.

It is preferred that the contact spring arms may have their bases or roots extending approximately to the root of the retaining spring arm, whereby a further elongation of the spring arms is obtained.

Inventively, the length of the retaining spring arm can further be such that when a force tending to bend it acts upon it, the retaining spring arm can support itself against the shoulder of the zone where the claw portion is bent for the offsetting purposes. Thus, the return-bending path of the retaining spring arm is clearly defined and it is impossible that the retaining spring arm might be overbent and become non-functioning.

According to a further feature of the invention the upper wall portion of the flattened tubular housing, which has a closed longitudinally extending centrally located abutment seam, may be provided at its end which is remote from the contact spring arms with two upwardly angled supporting arms. Also, the spacing which the outwardly offset contact spring arms have immediately at the bending zone, can be equal to the spacing between the free ends of the bent-up supporting arms and the offset of the claw portion which is located opposite these supporting arms. These measures permit a properly oriented insertion and positional fixation of the double flat-spring contact in the receiving chamber of a push-in housing, whereby the supporting arms simultaneously constitute the counter support for the retaining spring arm.

For increasing the spring paths and to enlarge the finding range, the free ends of the contact spring arms inwardly can be bent inwardly according to the invention; advantageously, the contact spring arms approach one another in a wedge-shaped configuration. These measures make it possible in a simple manner to provide the double flat-spring contact with an auxiliary spring according to a further embodiment of the invention.

The range of the finding range can be improved substantially according to the invention by providing outwardly directed locating strips in the end region of the contact spring arms. This forms a locating funnel which corresponds to an exterior prong spring. In the space surrounded by the contact spring arms the contact of the present invention may have an auxiliary spring, and if so it has the known advantages of a contact element known from the art which is provided with an auxiliary spring. This inventive combination of an inner auxiliary spring with the finding funnel makes the double flat-spring contact of the present invention into a universally suitable contact element which has particularly advantageous spring characteristics and an optimal locating and positioning capability. It goes without saying that this combination can also be used in known exterior prong springs, in which case the spring is provided with an inner auxiliary spring.

To produce the novel double flat-spring contact of the present invention, the invention suggests a method according to which the base portion is free-formed. Initially, the outer portions of the base part, which each carry a spring arm of the pair of spring arms, can bent upwardly in a U-shaped configuration, whereupon the upwardly extending arms of the now obtained U-shaped body are pressed in an angular manner and the body is thereafter formed to hollow shape. The free-forming of the base part assures that the labor-intensive use of forming mandrels can be omitted. Furthermore, the forming of the base part can be accomplished simultaneously with the finish-forming of the claw part. The free-forming makes possible, in conjunction with the narrow width of the blank, a forming speed which is very high and economical. According to a particular characteristic of the method of the invention the free ends of the upwardly bent U-arms of the base part can be pressed against one another when the base part is formed to the hollow shape, in accordance with the bell-crank effect or by overbending.

On hand of FIGS. 1 to 4 the invention will be explained in more detail by way of example.

Figure 1:
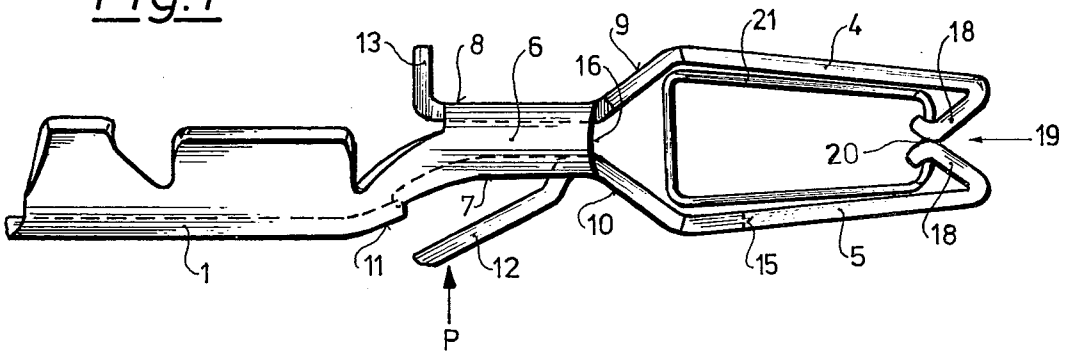
FIG. 1 is a side view of a double flat- spring contact.

The double flat-spring contact is formed of a sheet-metal blank which is stamped and which in its initial form has a transversely extending base strip from which there extend at right angles to one side the claw portion 1 for connection of an electrical conductor and to the other side strip-shaped portions which after appropriate deformation of the base strip constitute the contact spring arm pairs 2 and 3. FIG. 1 shows the contact spring arm pair 3 which is formed from the contact spring arms 4, 5.

The base portion is formed, preferably by a free-forming technique, to a tubular housing 6 having a parallel lower wall 7 and upper wall 8 and rounded sidewalls 9. The spring arms 4, 5 of each pair of spring arms 2, 3 are connected to the part 6 by an outwardly extending step-shaped bending zone 9, 10, and the claw portion 1 is similarly connected to the part 6 (but at the end oppoite the spring arm pairs 2, 3) by a similar outwardly extending bending portion 9.

The base part 6 is also provided with a retaining spring arm 12 which is cut from its bottom wall 7 and bent outwardly out of the plane thereof. The length of the arm 12 is so selected that when force acts upon it in the direction of the arrow P, its free end engages the shoulder which is formed by the deformation zone 11, so that is cannot be overbent.

The upper wall 8 of the housing 6 is provided with two projections at the end remote from the pairs of arms 2, 3, and these two projections are bent upwardly substantially at right angles and are configurated as supporting arms 13. The supporting arms 13 serve to fix the double flat-spring contact in a housing chamber and at the same time serve as a counter-support for the arm 12. FIG. 1 also shows that the combined width of the zones 9 and 10 corresponds to the distance between the zone 11 and the free ends of the arms 13.

The lower contact spring arms 5 are separated over approximately two-thirds of their length by a slot 14 which ends approximately at 15. The slot or slots 25 for the upper contact spring arms 4, however, extend to the forward edge 16 of the housing 6 or approximately to the root 17 of the arm 12 which is shown in broken lines. Thus, the spring arm pairs 2, 3 have an extremely long spring path and a correspondingly soft characteristic spring line.

The free ends of the contact spring arms 4, 5 approach one another in a wedge-shape and their end portions 18 are bent inwardly in the direction towards the housing 6. A respective large wedge-shaped finding region 19 is thus produced for the contact blade (not shown), and contact bulges 20 for the contact blade are formed whose rear-side constriction affords secure retention for an auxiliary spring 21 which is inserted into a contact-spring arm pair.

Figure 2:
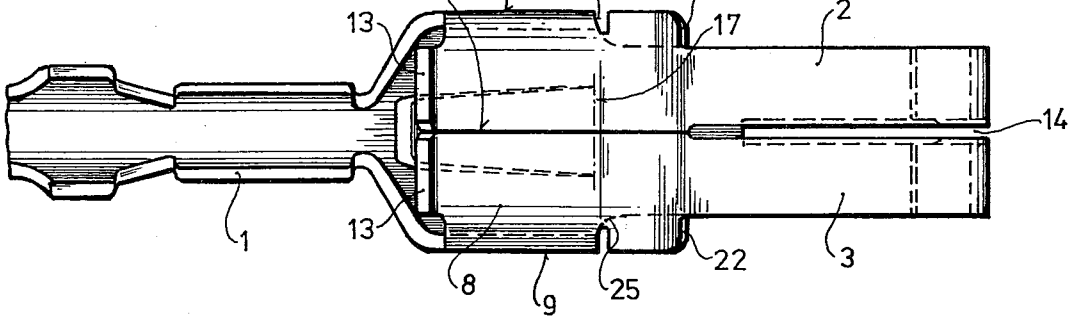
FIG. 2 is a top view of FIG. 1.

The top view in FIG. 2 also shows that the total width of the housing 6 is greater than the total width of the contact spring arm pairs 2 and 3. The shoulders 22 are thereby formed on the housing 6 constitute abutments when the double flat-spring contact is inserted, e.g. into a multiple contact housing.

The upper wall 8 of the housing 6 has a closed centrally located abutment seam 23. The edge portions forming the seam 23 are pressed firmly against one another, by over-dimensioning of the blank and by appropriate overbending during the free-formation, so that a great stability and resistance to twisting deformation results.

Figure 3:
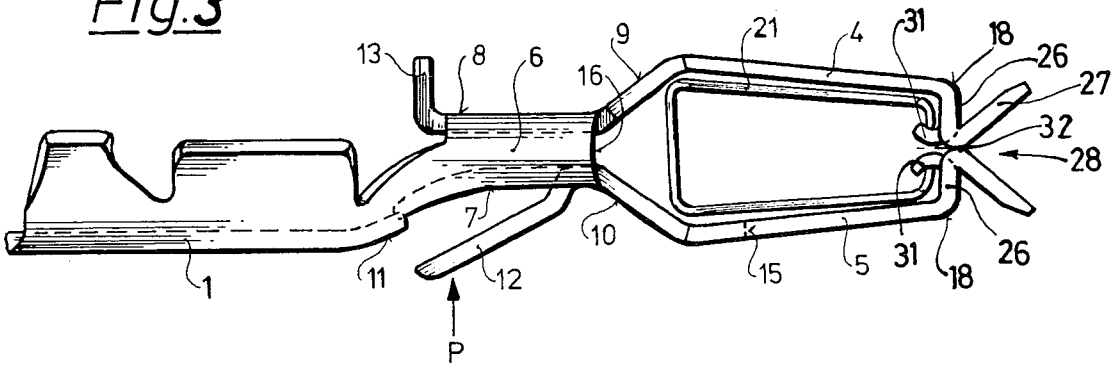
FIG. 3 is a side view of the double flat-spring contact with finding funnel.
Figure 4:
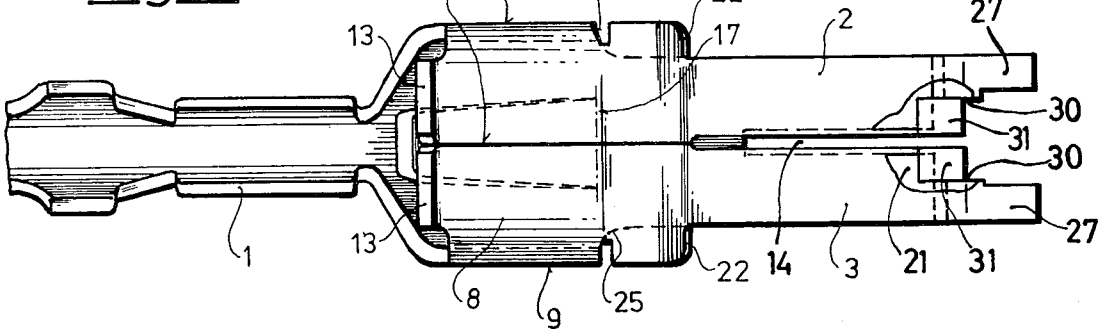
FIG. 4 is a part of a top view of the end region of the spring arms of a double flat-spring contact.

According to FIGS. 3 and 4 the spring arm pairs 2, 3 are bent almost at right angles in their end portions 18 adjacent to the conically shaped part, so that the portion 26 extends horizontally. Adjacent to the horizontal portion 26 each spring arm is longitudinally slotted so that two strips of material are obtained, the finding strip 27 and the spring receiving strip 31. Of these, the finding strip 27 is bent outwardly at an acute angle relative to the part 26, so that the cooperation of all finding strips yields a prong-spring type funnel 28. Each of the strips 31 is rolled to and inwardly respectively in direction towards the housing 6 and provides a firm retentive seat for the auxiliary spring 21. This also affords in an advantageous way the possibility of arresting the spring 21 by means of one or more not illustrated noses on the transition edges 30, so that it cannot slip laterally out of the inner spring arm space.

In FIGS. 3 and 4 the finding strips 27 are located outwardly and the spring receiving strips 31 are located inwardly. Self-evidently, it is also possible to arrange these strips in reversed relationship, namely the spring receiving strips on the outside and the finding strips on the inside. Also, the relationship of the width of the material strip, which is advantageously 1 : 1, can be varied in accordance with requirements.

In contradistinction to known constructions of double flat spring contacts, the inventive construction provides for an extremely short current path, because the contact bulge already acts as a contact point. The manufacture of the inventive double flat spring contact is very simple, especially in the finding region, because no angling is required any more, as in the known prong springs. The finding region is optimally large despite the use of an internal auxiliary spring. Particularly important is the horizontal arrangement of the region 26. The invention makes it thereby possible in a surprising manner to shape the finding and spring receiving strips functionally correctly in a manufacturing sense.

I claim:

1. A double-spring contact, comprising a one-piece body having a base part of substantially tubular configuration and having a top wall portion, a bottom wall portion parallel to said top wall portion and two curved side wall portions connecting said top and bottom wall portions; contact spring arms extending from said top and bottom wall portions at one end of said base part; a connecting portion extending from said bottom wall portion at the other end of said base part, said contact spring arms and said connecting portion all being stepped and offset at perspective bending zones in direction outwardly away from said base part; and a retaining spring arm formed from the material of said bottom wall portion and projecting outwardly away from the latter, the bending zone of said connecting portion forming an abutment shoulder, and the length of said retaining spring arm being so selected that a free end of said retaining spring arm engages said abutment shoulder when the retaining spring arm undergoes deflection in direction inwardly of said base part.

2. A contact as defined in claim 1, wherein said contact spring arms of said bottom wall portion are incisions in said base part.

3. A contact as defined in claim 1, wherein said contact spring arms approach one another in wedge-shaped configuration in direction away from said base part and have free end portions which are bent inwardly.

4. A contact as defined in claim 1; further comprising an auxiliary spring engaging and reinforcing the spring action of said contact spring arms.

5. A contact as defined in claim 1, wherein said contact spring arms have free end regions which are longitudinally split to form outwardly directed guide strips and inwardly rolled retaining strips adapted to engage an auxiliary spring.

6. A contact as defined in claim 1, said top wall portion having a seam extending lengthwise of said base part and at which opposite edges of a sheetmetal blank from which said body is constituted, abut one another.

7. A contact as defined in claim 6, said top wall portion having at the end remote from said contact spring arms a pair of outwardly bent supporting arms.

8. A double-spring contact, comprising a one-piece body having a base part of substantially tubular configuration and having a top wall portion, a bottom wall portion parallel to said top wall portion and two curved side wall portions connecting said top and bottom wall portions; contact spring arms extending from said top and bottom wall portions at one end of said base part; a connecting portion extending from said bottom wall portion at the other end of said base part, said contact spring arms and said connecting portion all being stepped and offset at perspective bending zones in direction outwardly away from said base part, said contact spring arms having free end regions which are longitudinally split to form outwardly directed guide strips and inwardly rolled retaining strips adapted to engage an auxiliary spring, and said contact spring arms each also having a substantially horizontal arm portion followed by the respective end region, the respective guide strips being bent outwardly at an acute angle and the respective retaining strips being rolled inwardly in direction towards said base part; and a retaining spring arm formed from the material of said bottom wall portion and projecting outwardly away from the latter.

* * * * *